US007643782B2

(12) United States Patent
Ishii et al.

(10) Patent No.: US 7,643,782 B2
(45) **Date of Patent: *Jan. 5, 2010**

(54) BELT DRIVING APPARATUS

(75) Inventors: Kunihiko Ishii, Osaka (JP); Hiroshi Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/802,167

(22) Filed: May 21, 2007

(65) Prior Publication Data

US 2007/0223978 A1 Sep. 27, 2007

Related U.S. Application Data

(63) Continuation of application No. 11/274,472, filed on Nov. 16, 2005, now Pat. No. 7,245,857.

(30) Foreign Application Priority Data

Nov. 22, 2004 (JP) ..... 2004-337151

(51) Int. Cl.
*G03G 15/01* (2006.01)

(52) U.S. Cl. ..... 399/302; 399/303; 399/308; 399/329; 198/806; 198/807; 198/837; 198/840

(58) Field of Classification Search ..... 399/162–165, 399/302–303, 308, 329; 198/806–807, 837, 198/840

See application file for complete search history.

(56) References Cited

U.S. PATENT DOCUMENTS 3,657,779 A * 4/1972 Granberry ..... 198/842
4,397,538 A 8/1983 Castelli et al.
4,674,858 A 6/1987 Nagayama
5,117,970 A * 6/1992 Gibbs ..... 198/842
6,002,908 A 12/1999 Hayashi et al.
6,160,978 A 12/2000 Tsuruoka et al.
6,397,033 B1 * 5/2002 Todome ..... 399/303
6,912,371 B2 6/2005 Sato (Continued)

FOREIGN PATENT DOCUMENTS

JP 04242280 A * 8/1992

(Continued)

OTHER PUBLICATIONS

English translation of Kurokawa et al. (JP pub 2002-173247), published Jun. 21, 2002.*

(Continued)

*Primary Examiner*—David M Gray
*Assistant Examiner*—Geoffrey T Evans
(74) *Attorney, Agent, or Firm*—Smith, Gambrell & Russell, LLP

(57) ABSTRACT

A belt driving apparatus for driving a belt has the belt hung around and between rollers, and has a meandering prevention member provided in each end part of each roller to restrict the meandering of the belt in the roller axial direction. A cut is formed to be open toward the roller end face and to extend in the roller axial direction, and a boss that fits into the cut is formed on the inner circumference of the meandering prevention member.

3 Claims, 16 Drawing Sheets

U.S. PATENT DOCUMENTS

| | | | | |
|---|---|---|---|---|
| 6,963,719 | B2 | 11/2005 | Jaskowiak | |
| 7,245,857 | B2 * | 7/2007 | Ishii et al. | 399/162 |
| 2001/0022903 | A1 | 9/2001 | Shirasawa et al. | |
| 2002/0085864 | A1 | 7/2002 | Abe | |
| 2003/0091373 | A1 | 5/2003 | Abe et al. | |

FOREIGN PATENT DOCUMENTS

| | | | |
|---|---|---|---|
| JP | 8-119484 | | 5/1996 |
| JP | 08119484 | | 5/1996 |
| JP | 11-133771 | | 5/1999 |
| JP | 2000075700 | A * | 3/2000 |
| JP | 2001194843 | A * | 7/2001 |

OTHER PUBLICATIONS

English translation of Kozuki, et al. (JP pub 2000-075700); published Mar. 14, 2000; Kozuki, Yoshida, Kurotaka.*

English translation of Oyama, et al. (JP pub 04-242280); published Aug. 28, 1992; Oyama, Okamoto.*

* cited by examiner

BELT DRIVING APPARATUS

CROSS REFERENCE TO RELATED APPLICATION

This application is a continuation of Ser. No. 11/274,472, filed Nov. 16, 2005, now U.S. Pat. No. 7,245,857, and which is being incorporated in its entirety herein by reference.

BACKGROUND OF THE INVENTION

1. Field of the Invention

The present invention relates to a belt driving apparatus, and more particularly to a belt driving apparatus incorporated in a copier, printer, or the like.

2. Description of Related Art

In general, a belt driving apparatus incorporated in a copier, printer, or the like is faced with a problem in which a dimension error or fitting error in a roller causes a belt to meander in the roller axial direction, that is, in the lateral direction. As a solution to this problem, for example in the belt driving apparatus proposed in JP-A-H8-119484, in each end part of a roller, a C-shaped meandering prevention member having a cut formed in the direction of the outer circumference of the roller is fitted to restrict the meandering of a belt in the roller axial direction.

However, since a belt is formed of a thin elastic material that is highly flexible, when a meandering prevention member is fitted in each end part of a roller, a dimension error in the outer diameter of the roller or in the inner diameter of the meandering prevention member may produce a gap in which the belt may be caught. Letting the belt, thus caught between the roller and the meandering prevention member, rotate may break the edge of the belt.

To overcome this problem, as shown in FIGS. 17A and 17B, a roller 104 is commonly formed such that, of the outer circumference thereof, a middle part 104*d*, where a belt 101 is hung, is given a different outer diameter from a shaft part 104*c* at each end, where a meandering prevention member 111 is fitted; that is, the middle part 104*d* is given a larger diameter than the shaft part 104*c* at each end to produce a diameter difference in the outer circumference of the roller so that the belt 101 makes contact with the side face of the meandering prevention member 111. This prevents the belt 101 from being caught in the gap between the roller 104 and the meandering prevention member 111. In FIGS. 17A and 17B, reference numeral 105 represents a heater lamp, reference numeral 114 represents a bracket, reference numeral 115 represents a side plate of a belt fixing unit, and reference numeral 116 represents a stop ring.

A diameter difference in a roller as described above can be formed, for example, by swaging each end part of a thin-walled cylindrical metal core, or by fitting, to each end of a metal core, a separately prepared smaller-diameter shaft member. These processes, however, are troublesome and costly, and therefore it is more practical to form a diameter difference by cutting, in each end part of a thick-walled cylindrical metal core, the outer circumference thereof into a predetermined depth. Thus, to obtain sufficient mechanical strength at the shaft part at each end of a roller and simultaneously obtain a sufficient diameter difference, it is necessary to use a thick-walled metal core. This inevitably makes the roller 104 quite thick in the middle part 104*d* thereof.

Thus, when this belt driving apparatus is used as a belt fixing unit as shown in FIGS. 17A and 17B (here, it is assumed that a bar-shaped heater lamp 105 is arranged in the hollow interior of the roller 104), the roller itself has too high a heat capacity to sufficiently conduct fixing heat to the belt.

In view of the conventionally encountered problem discussed above, it is an object of the present invention to provide a belt driving apparatus that prevents an increase in the heat capacity of a roller and that prevents the belt from being caught in a gap between the roller and a meandering prevention member.

SUMMARY OF THE INVENTION

To achieve the above object, according to one aspect of the present invention, a belt driving apparatus for driving a belt is provided with: the belt hung around and between rollers; and a meandering prevention member provided in each end part of each roller to restrict the meandering of the belt in the roller axial direction. Moreover, a boss-and-hole fitting mechanism is provided between the inner circumference of the meandering prevention member and the outer circumference of the roller.

According to another aspect of the present invention, a belt driving apparatus for driving a belt is provided with: the belt hung around and between rollers; and a meandering prevention member provided in each end part of each roller to restrict the meandering of the belt in the roller axial direction. Moreover, a cut is formed so as to be open toward the roller end face and to extend in the roller axial direction, and a boss that fits into the cut is formed on the inner circumference of the meandering prevention member.

Here, the meandering prevention member may be a ring-shaped member formed as a single integral member.

According to still another aspect of the present invention, a belt driving apparatus for driving a belt is provided with: the belt hung around and between rollers; and a meandering prevention member provided in each end part of each roller to restrict the meandering of the belt in the roller axial direction. Moreover, a hole is formed so as to penetrate the outer circumference of the roller, and a boss that fits into the hole is formed on the inner circumference of the meandering prevention member.

Here, the meandering prevention member may be a ring-shaped member composed of a plurality of separately formed blocks. Moreover, each block may be tapered in, with respect to the rotation direction, a down-stream end side part thereof where the block is adjacent both to the seam with the next block and to the belt.

DETAILED DESCRIPTION OF PREFERRED EMBODIMENTS

Hereinafter, examples of how best the present invention can be carried out will be described with reference to the drawings.

First Embodiment

The belt driving apparatus of a first embodiment of the present invention will be described below with reference to the relevant drawings. This embodiment deals with a case where the belt driving apparatus is used as a belt fixing unit.

Figure 1:
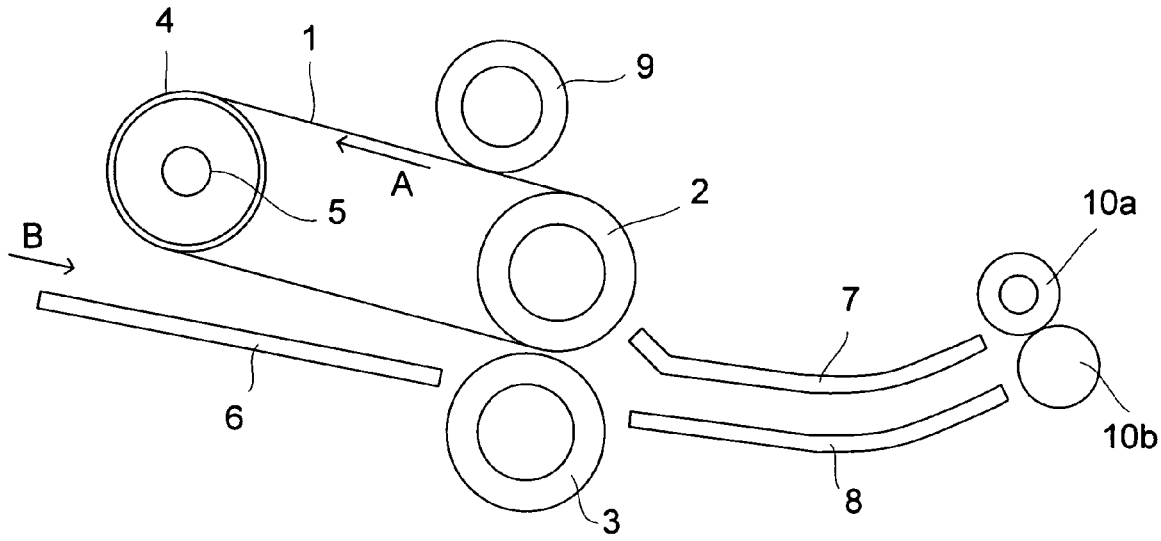
FIG. 1 is a diagram showing an outline of the construction around a belt fixing unit in a copying apparatus incorporating the belt driving apparatus of a first embodiment of the present invention.

FIG. 1 shows an outline of the construction of and around the belt fixing unit in a copying apparatus. The belt fixing unit is composed essentially of a fixing belt 1, a drive roller 2, a backup roller 3, a tension roller 4, and an oil application roller 9. The fixing belt 1 is hung around and between the drive roller 2 and the tension roller 4, and is driven by the drive roller 2 to rotate in the direction indicated by arrow A. The fixing belt 1 is an endless belt formed of a thin nickel plate with a thickness of 40 μm, and has the outer circumferential face thereof coated with an offsetting prevention material such as a silicon rubber coating.

Arranged close to the drive roller 2, the backup roller 3 holds copying paper between itself and the drive roller 2 and presses the copying paper against the lower running part of the fixing belt 1. The drive roller 2 and the backup roller 3 are both rubber rollers. The tension roller 4 applies tension to the fixing belt 1, and is built as a cylindrical aluminum tube with a wall thickness uniform in the axial direction. In the hollow interior of the tension roller 4, a bar-shaped heater lamp 5 is arranged. The heater lamp 5 heats, via the tension roller 4, the fixing belt 1.

The oil application roller 9 feeds offsetting prevention oil to the upper running part of the fixing belt 1. Around the fixing belt 1, there are arranged a pre-fixing guide 6, post-fixing guides 7 and 8, and a pair of transport rollers 10*a* and 10*b*. The pre-fixing guide 6 allows the copying paper transported from a photoconductive drum to be transported toward the belt fixing unit, that is, in the direction indicated by arrow B. The copying paper is preliminarily heated with the heat of the heater lamp 5 while passing along the pre-fixing guide 6, and is then heated by being pressed against the fixing belt 1, so that the toner image that has been transferred on the copying paper is fixed. The post-fixing guides 7 and 8 and the transport rollers 10*a* and 10*b* allow the copying paper having gone through the fixing process to be ejected into a tray provided outside the copying apparatus.

Figure 2:
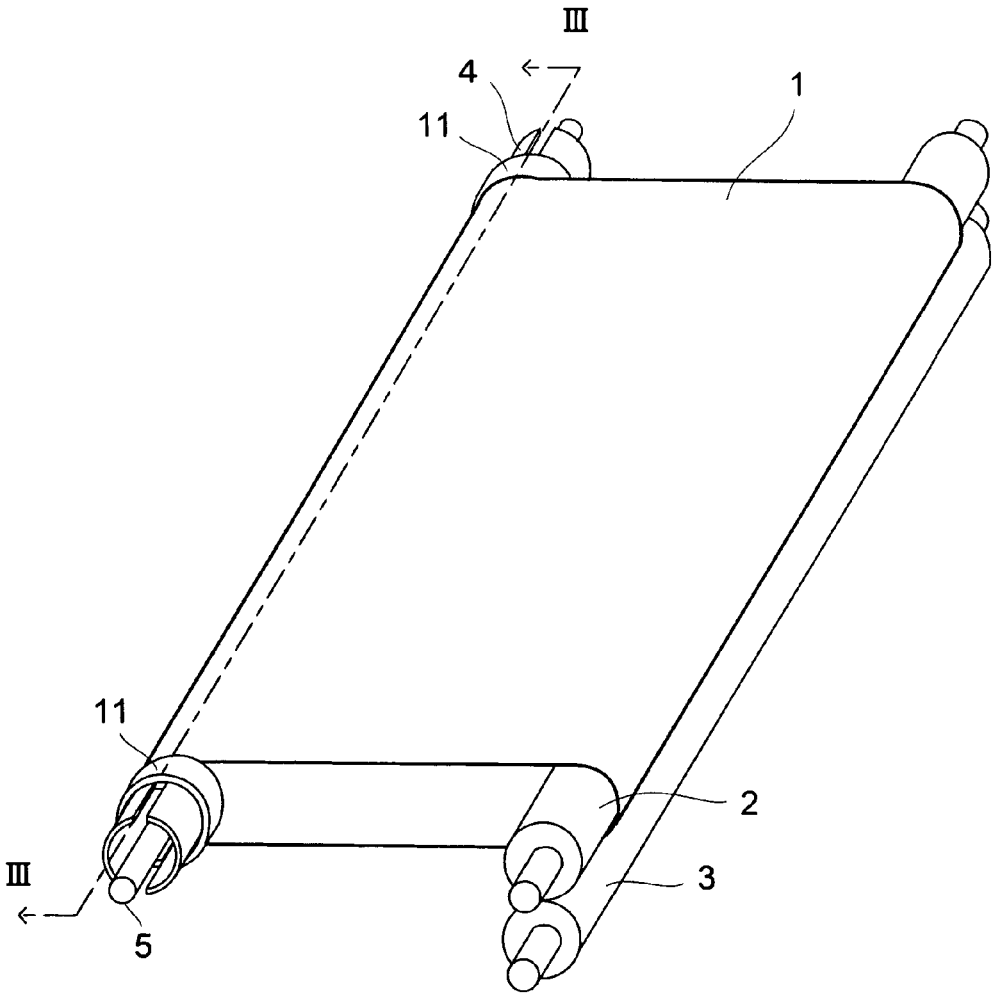
FIG. 2 is a perspective view showing the belt driving apparatus shown in FIG. 1, with the brackets and stop rings omitted.
Figure 3:
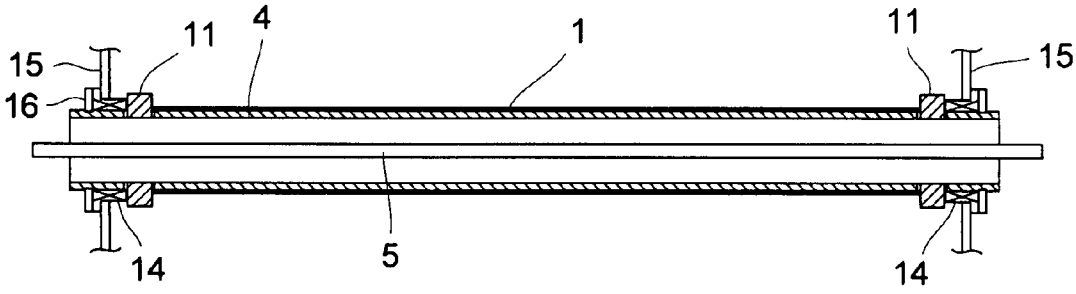
FIG. 3 is a sectional view taken along line III-III shown in FIG. 2.

Next, the workings and benefits of a meandering prevention member 11 that restricts the meandering of the fixing belt 1 in the roller axial direction will be described by way of practical examples thereof. As shown in FIGS. 2 and 3, a meandering prevention member 11 is fitted in each end part of the tension roller 4. The distance between the two meandering prevention members 11 is set slightly greater than the width of the fixing belt 1. The tension roller 4 is, at the parts thereof outside where the meandering prevention members 11 are fitted thereto, supported on brackets 14 so as to be freely rotatable. The brackets 14 are fitted on the side plates 15 of the belt fixing unit. The brackets 14 also serve to prevent the meandering prevention members 11 from falling off. Further outward in the end parts of the tension roller 4, C-shaped stop rings 16 are fitted that serve to prevent the brackets from falling off.

Figure 4:
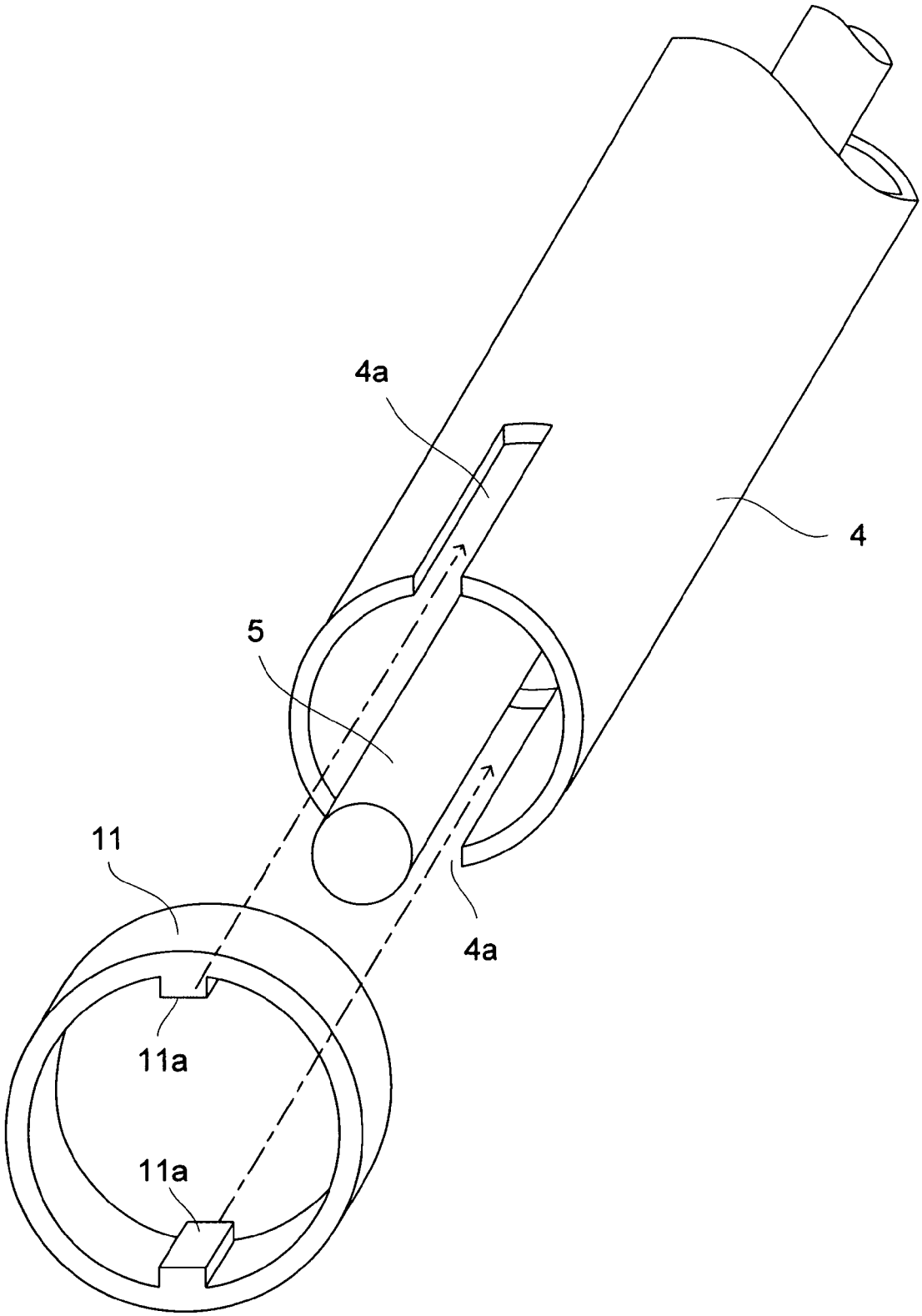
FIG. 4 is an exploded perspective view showing an end part of a tension roller in the belt driving apparatus of the first embodiment, with the fixing belt, brackets, and stop rings omitted.
Figure 5A:
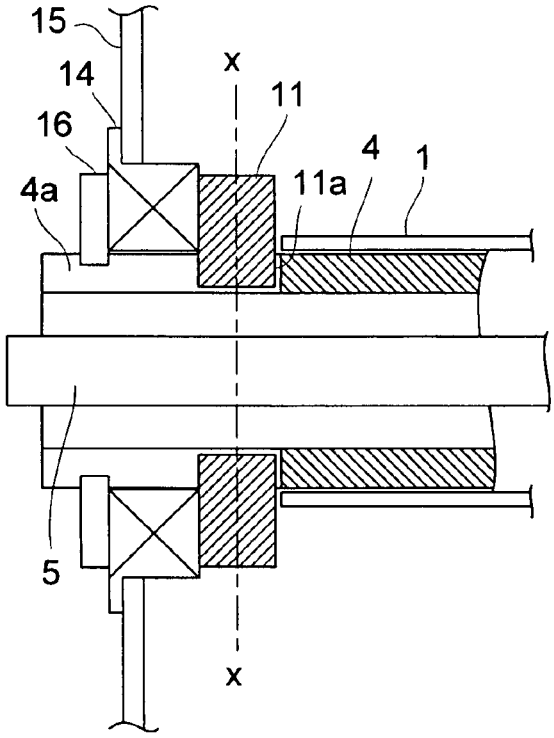
FIG. 5A is a sectional view, along the axial direction, of FIG. 4.
Figure 5B:
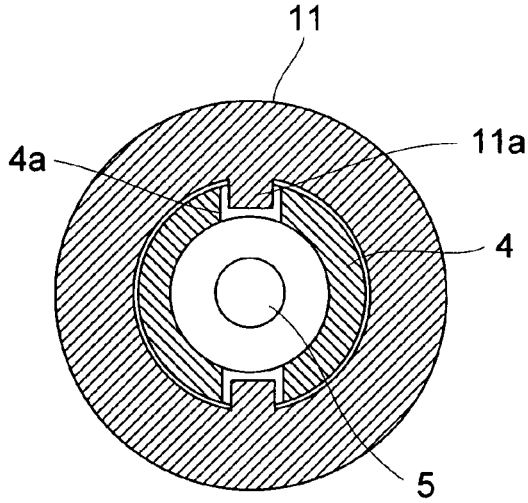
FIG. 5B is a sectional view taken along line x-x shown in FIG. 5A.

As shown in FIGS. 4, 5A, and 5B, in each end part of the tension roller 4, two cuts 4*a* open toward the roller end face and extending in the roller axial direction are formed at opposite positions. Each meandering prevention member 11 is a ring-shaped member formed as a single integral member, and, on the inner circumferential face thereof, two rectangular-columnar bosses 11*a* extending in the axial direction are formed at opposite positions. The outer diameter of the tension roller 4 and the inner diameter of the meandering prevention member 11 are set approximately equal.

The meandering prevention member 11 is fitted to the tension roller 4 in the following manner. As shown in FIG. 4, from off one end of the tension roller 4 in the roller axial direction, the meandering prevention member 11 is slid coaxially onto the tension roller 4 so as to be fitted around the outer circumference thereof. Meanwhile, the bosses 11*a* on the meandering prevention member 11 are fitted into the cuts 4*a* in the tension roller 4 from the open sides thereof.

With this construction, as shown in FIG. 5A, the side faces of the bosses 11*a* of the meandering prevention member 11 make contact with the edge of the fixing belt 1. This prevents the fixing belt 1 from being caught in the gap between the outer circumference of the tension roller 4 and the inner circumference of the meandering prevention member 11, and thereby prevents the fixing belt 1 from meandering in the axial direction of the tension roller 4. It is also possible to use as the tension roller 4 an existing thin-walled one. This helps prevent an increase in the heat capacity of the tension roller 4.

Second Embodiment

Next, the belt driving apparatus of a second embodiment of the present invention will be described with reference to the relevant drawings. In the description of this embodiment, such parts as are found also in the belt driving apparatus of the first embodiment described above are identified with common reference numerals, and their detailed explanations will not be repeated.

Figure 6:
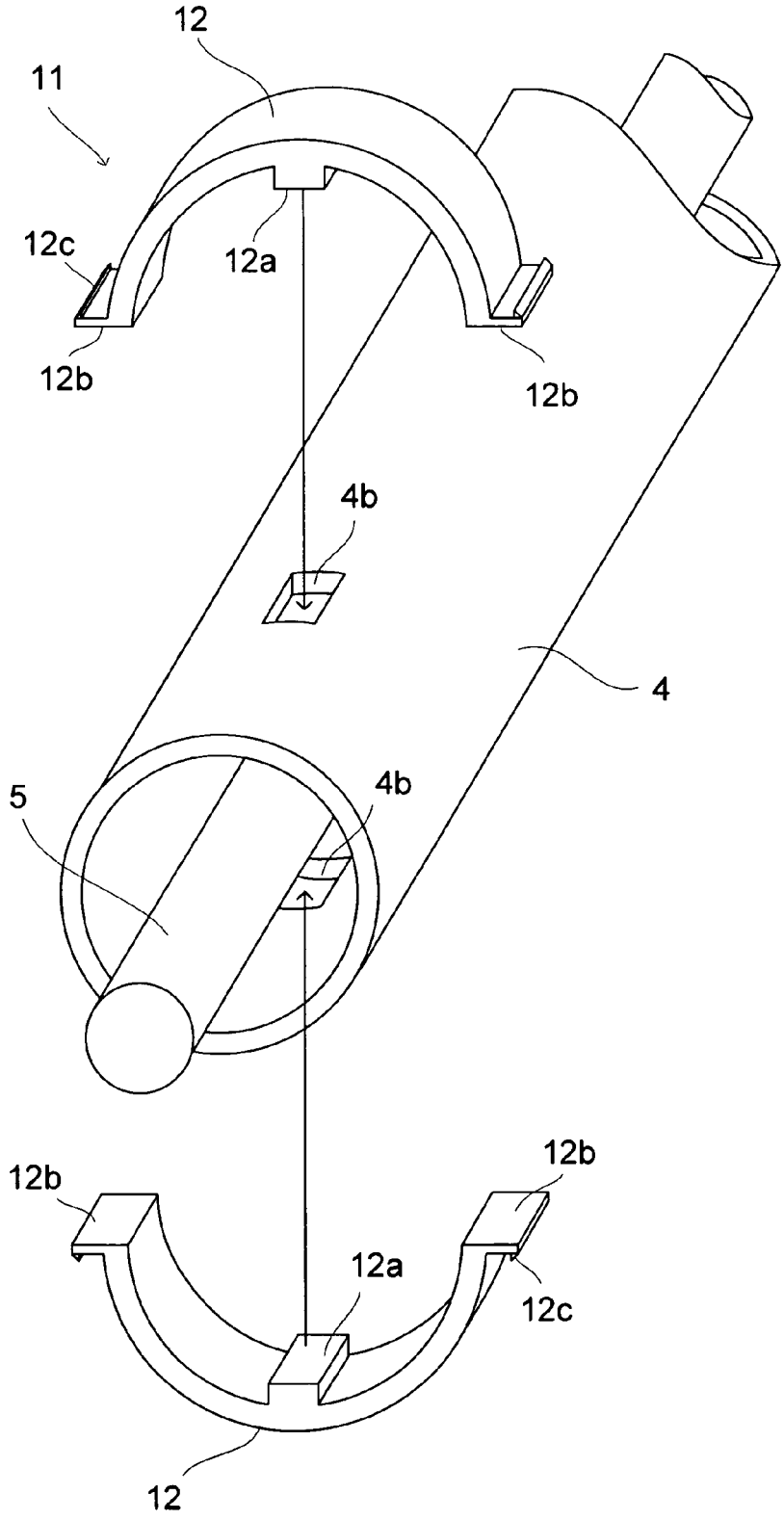
FIG. 6 is an exploded perspective view showing an end part of a tension roller in the belt driving apparatus of the second embodiment of the present invention, with the fixing belt, brackets, and stop rings omitted.
Figure 7A:
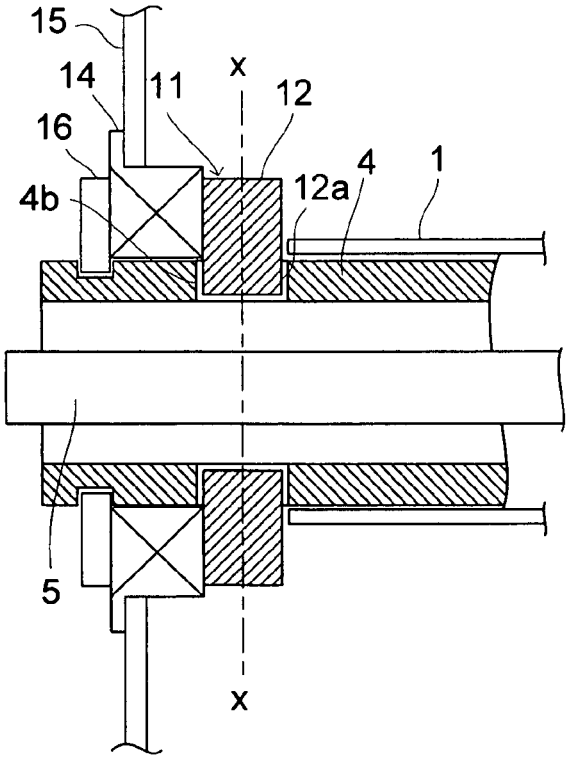
FIG. 7A is a sectional view, along the axial direction, of FIG. 6.
Figure 7B:
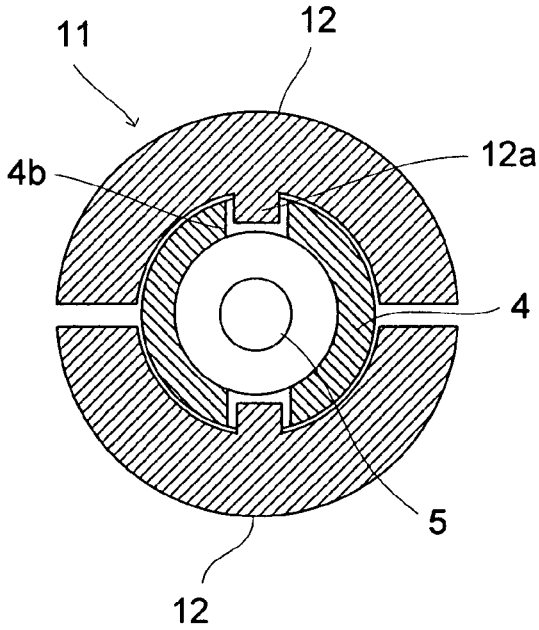
FIG. 7B is a sectional view taken along line x-x shown in FIG. 7A.

As shown in FIGS. 6, 7A, and 7B, in each end part of the tension roller 4, two rectangular holes 4*b* penetrating the outer circumference of the roller are formed at opposite positions. Each meandering prevention member 11 is a ring-shaped member composed of two separately formed, identically shaped blocks 12. In a middle part on the inner circumferential face of each block 12 in the circumferential direction thereof, a rectangular-columnar boss 12*a* extending in the axial direction is formed. Moreover, in each end part of the outer circumferential face of each block 12, a fastening piece 12*b* is formed that has a hook-shaped claw 12*c* formed integrally therewith at the tip end thereof. The outer diameter of the tension roller 4 and the inner diameter of the meandering prevention member 11 are set approximately equal. The length of each block 12 in the circumferential direction thereof is set slightly shorter than that of a semicircle so that, when the meandering prevention member 11 is fitted around the outer circumference of an end part of the tension roller 4, gaps are left between the circumferential direction end faces of the blocks 12 (see FIG. 7B).

The meandering prevention member 11 is fitted to the tension roller 4 in the following manner. As shown in FIG. 6, from off the outer circumference of the tension roller 4 in directions perpendicular to the roller axis thereof, the two blocks 12 are fitted onto the outer circumference of the tension roller 4 so as to sandwich it. Meanwhile, the bosses 12*a* on the blocks 12 are fitted into the holes 4*b* in the tension roller 4. Moreover, the two blocks 12 are fastened together by tying together the adjacent fastening pieces 12*b* thereof with heat-resistant rubber belts (unillustrated) wound around them inward of the claws 12*c* thereof.

With this construction, as shown in FIG. 7B, the side faces of the bosses 12*a* of the block 12 make contact with the edge of the fixing belt 1. This prevents the fixing belt 1 from being caught in the gap between the outer circumference of the tension roller 4 and the inner circumference of the meandering prevention member 11, and thereby prevents the meandering of the fixing belt 1 in the axial direction of the tension roller 4. It is also possible to use as the tension roller 4 an existing thin-walled one. This helps prevent an increase in the heat capacity of the tension roller 4.

In particular in this embodiment, since gaps are formed between the circumferential direction end faces of the blocks 12, even when the tension roller 4 is heated by the heater lamp 5 and thus it thermally deforms and expands, the deformation is absorbed by the gaps, which thus contract. This helps prevent the meandering prevention member 11 itself from developing mechanical stress, and thus helps prevent breakage thereof. Moreover, as shown in FIG. 7A, since the bosses 12*a* of the block 12 fit into the holes 4*b* in the outer circumferential face of the tension roller 4, the meandering prevention member 11, even when pressed by the meandering fixing belt 1, is prevented from deviating in the axial direction of the tension roller 4.

Figure 8:
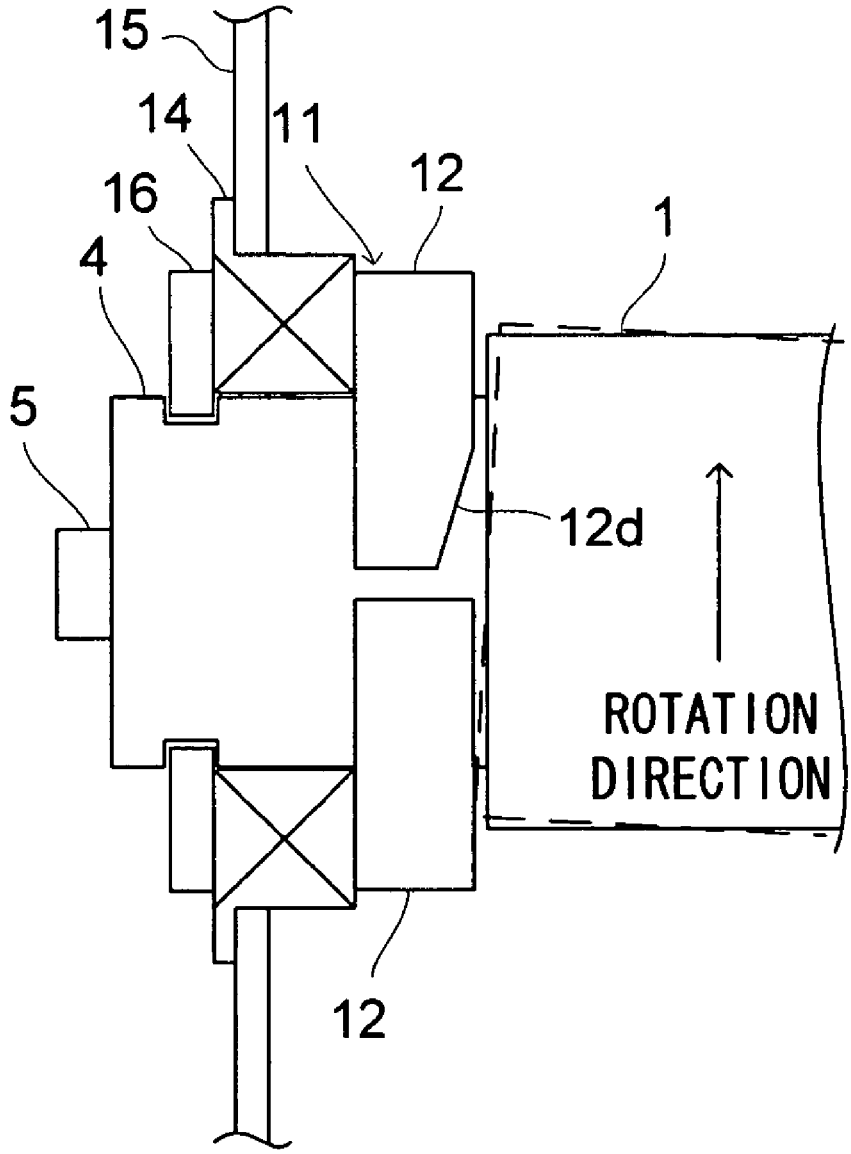
FIG. 8 is a plan view showing another example of an end part of a tension roller in the belt driving apparatus of the second embodiment.

Furthermore, as shown in FIG. 8, each block 12 may be tapered 12*d* in, with respect to the rotation direction, a downstream end side part thereof where the block 12 is adjacent both to the seam with the next block 12 and to the belt 1. This allows the fixing belt 1, even when it is displaced into a position indicated by broken lines while rotating, to make gentle contact with the seam part of the downstream-side block 12 with respect to the rotation direction. This helps prevent the fixing belt 1 from being caught at the seam.

Third Embodiment

Next, the belt driving apparatus of a third embodiment of the present invention will be described with reference to the relevant drawings. In the description of this embodiment, such parts as are found also in the belt driving apparatus of the first embodiment described above are identified with common reference numerals, and their detailed explanations will not be repeated.

Figure 9:
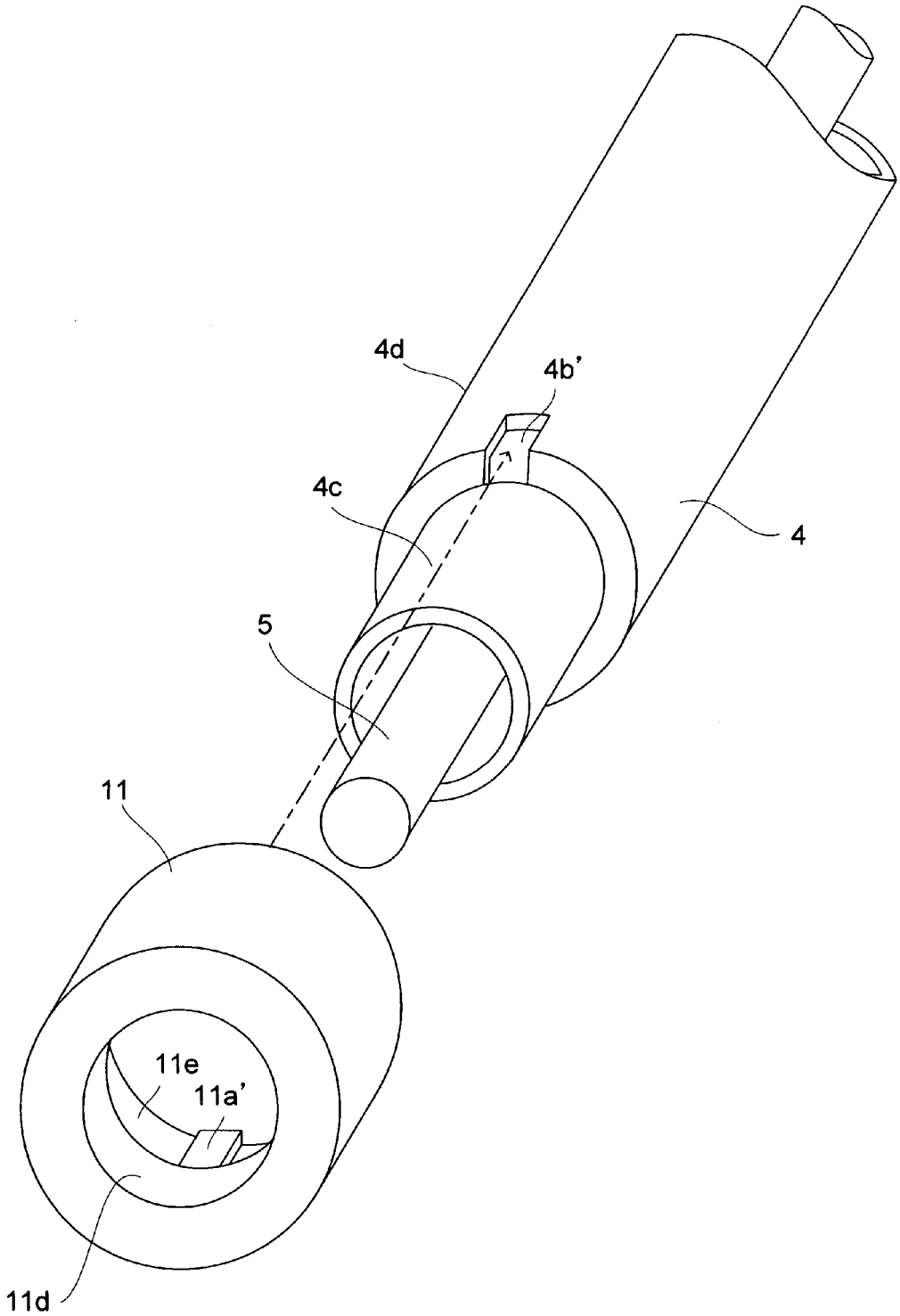
FIG. 9 is an exploded perspective view showing an end part of a tension roller in the belt driving apparatus of a third embodiment of the present invention, with the fixing belt, brackets, and stop rings omitted.
Figure 10:
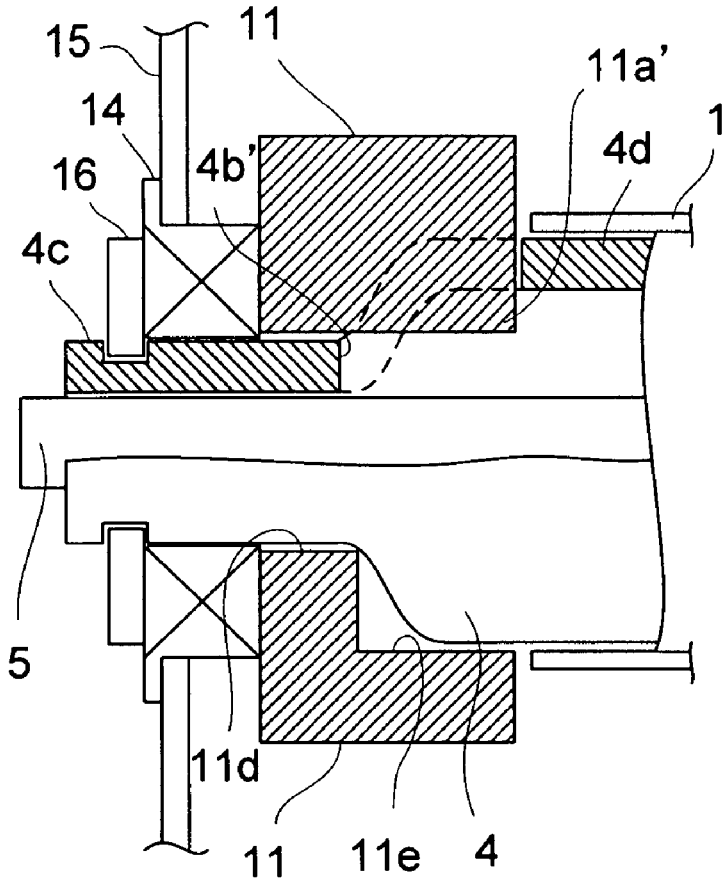
FIG. 10 is a sectional view, along the axial direction, of FIG. 9.
Figure 11A:
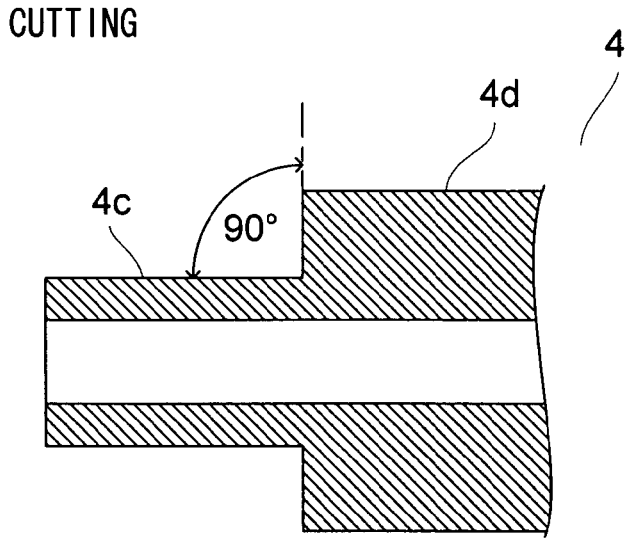
FIG. 11A is a sectional view illustrating, in comparison with FIG. 11B, how a differently shaped diameter difference is produced in the outer circumference of a roller when an end part of a tension roller is cut into a smaller-diameter shaft part.
Figure 11B:
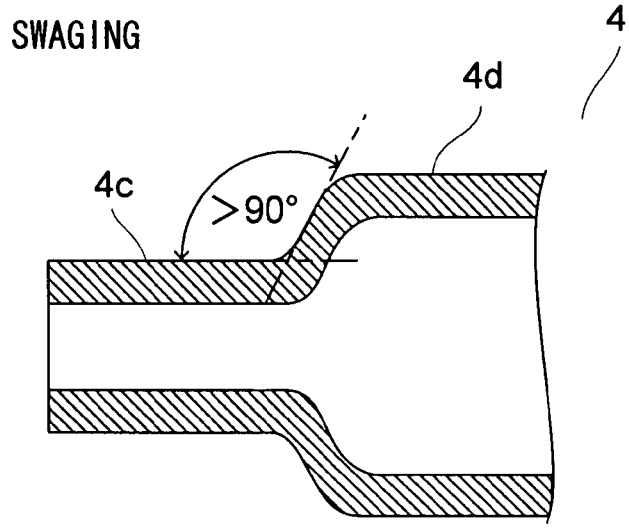
FIG. 11B is a sectional view illustrating, in comparison with FIG. 11A, how a differently shaped diameter difference is produced in the outer circumference of a roller when an end part of a tension roller is swaged into a smaller-diameter shaft part.
Figure 12A:
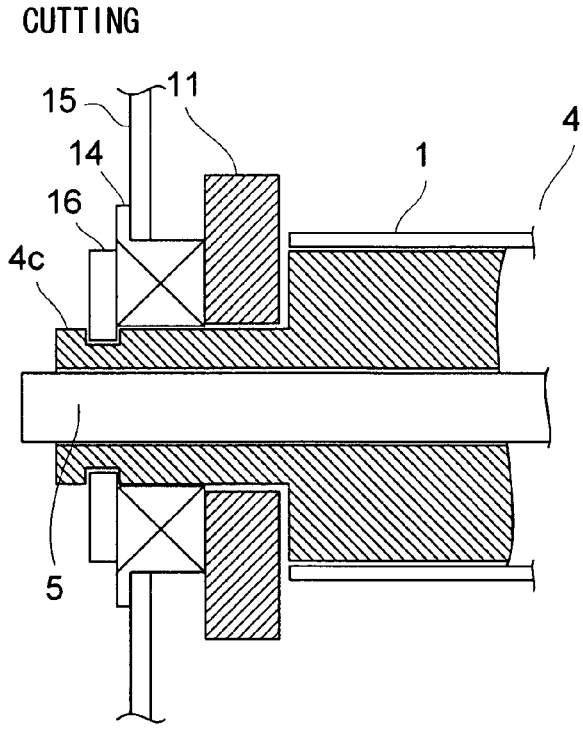
FIG. 12A is a sectional view illustrating, in comparison with FIG. 12B, how a differently shaped diameter difference causes the fixing belt to behave differently when a ring-shaped meandering prevention member is fitted around the outer circumference of the shaft part of the roller.
Figure 12B:
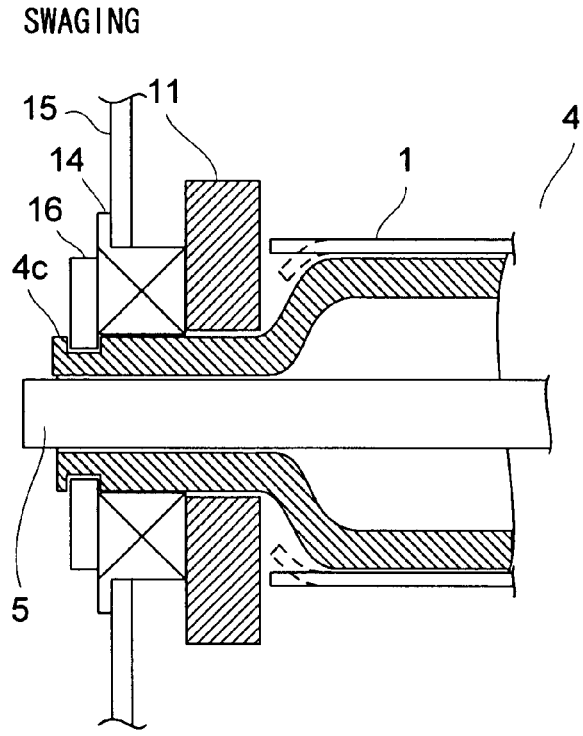
FIG. 12B is a sectional view illustrating, in comparison with FIG. 12A, how a differently shaped diameter difference causes the fixing belt to behave differently when a ring-shaped meandering prevention member is fitted around the outer circumference of the shaft part of the roller.

As shown in FIGS. 9 and 10, in each end part of the tension roller 4, a metal core is swaged into a shaft part 4*c* having a smaller diameter than a middle part 4*d*. The shaft part 4*c* may instead be formed comparatively easily by cutting such that a diameter difference is formed perpendicularly between the shaft part 4*c* and the middle part 4*d* (see FIG. 11A). In this case, when a ring-shaped meandering prevention member 11 is fitted around the outer circumference of the shaft part 4*c*, the end face of the meandering prevention member 11 makes contact with the wall face of the diameter difference. This helps prevent the fixing belt 1 from slipping into where the diameter difference is formed (see FIG. 12A). On the other hand, when the shaft part 4*c* is formed by swaging, the smaller the wall thickness of the metal core, the duller the swaged part (see FIG. 11B). Thus, when a ring-shaped meandering prevention member 11 is fitted around the outer circumference of the shaft part 4*c*, a gap is left at the swaged part. This may cause the fixing belt 1 to slip into the gap, leading to entanglement or breakage thereof (see FIG. 12B).

This embodiment is characterized by a construction that overcomes the problem of the gap formed at the swaged part.

As shown in FIGS. 9 and 10, two rectangular holes 4*b*' extending across the swaged part of the tension roller 4 to the middle part 4*d* are formed at opposite positions. The meandering prevention member 11 is a ring-shaped member formed as a single integral member, and, on the inner circumference thereof, a diameter difference is formed perpendicularly so that the meandering prevention member 11 has a small-inner-diameter part 11*d* in one end side thereof in the axial direction and a large-inner-diameter part 11*e* in the other end side thereof in the axial direction. On the inner circumferential face of the large-inner-diameter part 11*e*, two rectangular-columnar bosses 11*a*' extending in the axial direction are formed at opposite positions. The bosses 11*a*' are formed so high as to level with the inner circumferential face of the small-inner-diameter part 11*d*. The outer diameter of the shaft part 4*c* of the tension roller 4 and the inner diameter of the small-inner-diameter part 11*d* of the meandering prevention member 11 are set approximately equal, and the outer diameter of the central part 4*d* of the tension roller 4 and the inner diameter of the large-inner-diameter part 11*e* of the meandering prevention member 11 are set approximately equal.

The meandering prevention member 11 is fitted to the tension roller 4 in the following manner. As shown in FIG. 9, from off one end of the tension roller 4 in the roller axial direction, the meandering prevention member 11 is slid coaxially onto the tension roller 4 so as to be fitted around the outer circumference thereof. Meanwhile, the bosses 11' on the meandering prevention member 11 are fitted into the holes 4*a*' in the tension roller 4 from the open sides thereof in the axial direction.

With this construction, as shown in FIG. 10, the side faces of the bosses 11*a*' of the meandering prevention member 11 make contact with the edge of the fixing belt 1. This prevents the fixing belt 1 from being caught in the gap between the outer circumference of the tension roller 4 and the inner circumference of the meandering prevention member 11, and thereby prevents the fixing belt 1 from meandering in the axial direction of the tension roller 4. It is also possible to use as the tension roller 4 an existing thin-walled one. This helps prevent an increase in the heat capacity of the tension roller 4.

In particular in this embodiment, as shown in FIG. 11, the meandering prevention member 11 covers the swaged part of the tension roller 4, and the other end face of the meandering prevention member 11 lies on the outer circumference of the central part 4*d* of the tension roller 4. Thus, no gap is left at the swaged part. This help prevent the fixing belt 1 from slipping into a gap.

Fourth Embodiment

Next, the belt driving apparatus of a fourth embodiment of the present invention will be described with reference to the relevant drawings. In the description of this embodiment, such parts as are found also in the belt driving apparatus of the first embodiment described above are identified with common reference numerals, and their detailed explanations will not be repeated.

This embodiment, like the third embodiment described above, is characterized by a construction that overcomes the problem of the gap formed at the swaged part of the tension roller 4.

Figure 13:
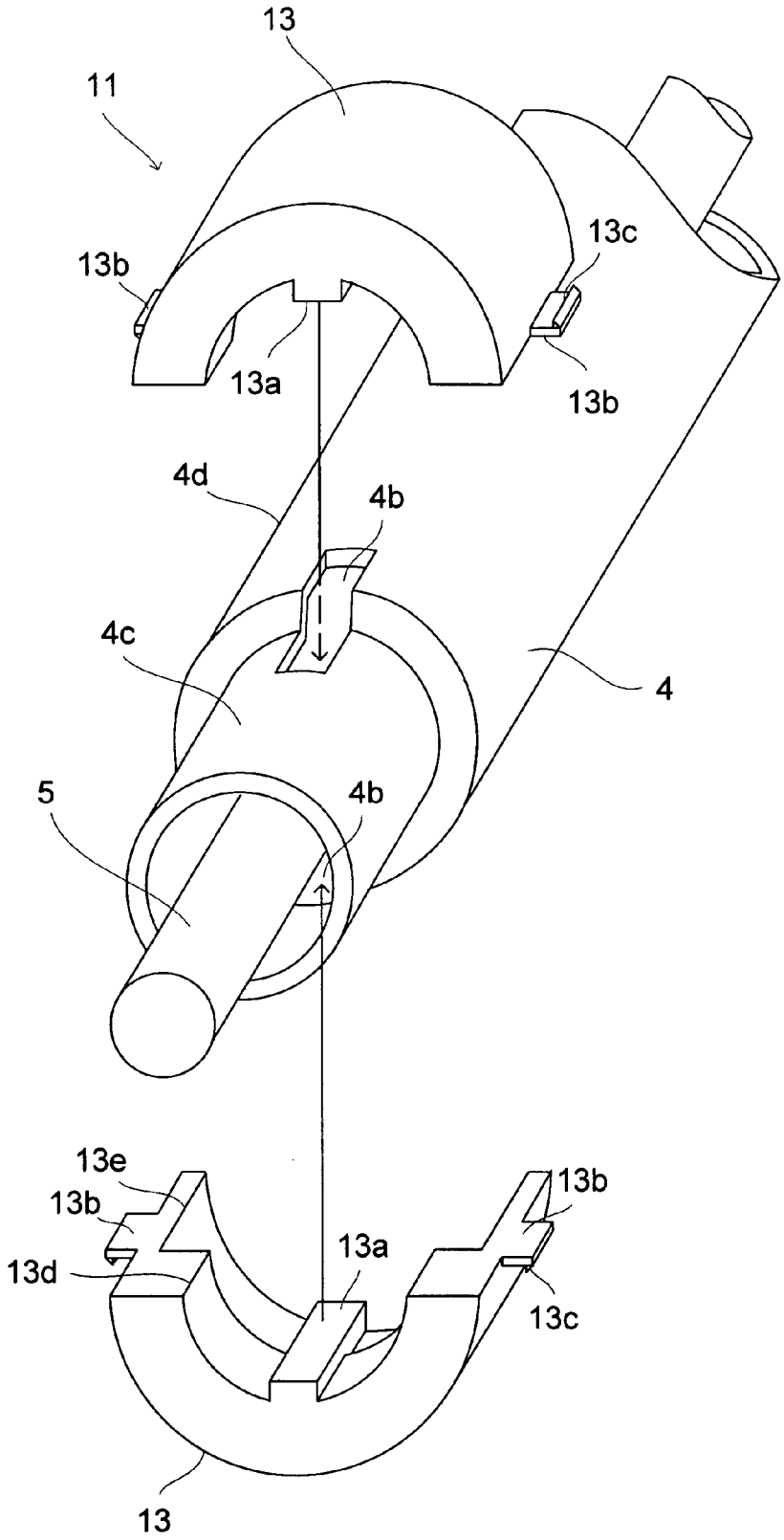
FIG. 13 is an exploded perspective view showing an end part of a tension roller in the belt driving apparatus of a fourth embodiment of the present invention, with the fixing belt, brackets, and stop rings omitted.
Figure 14:
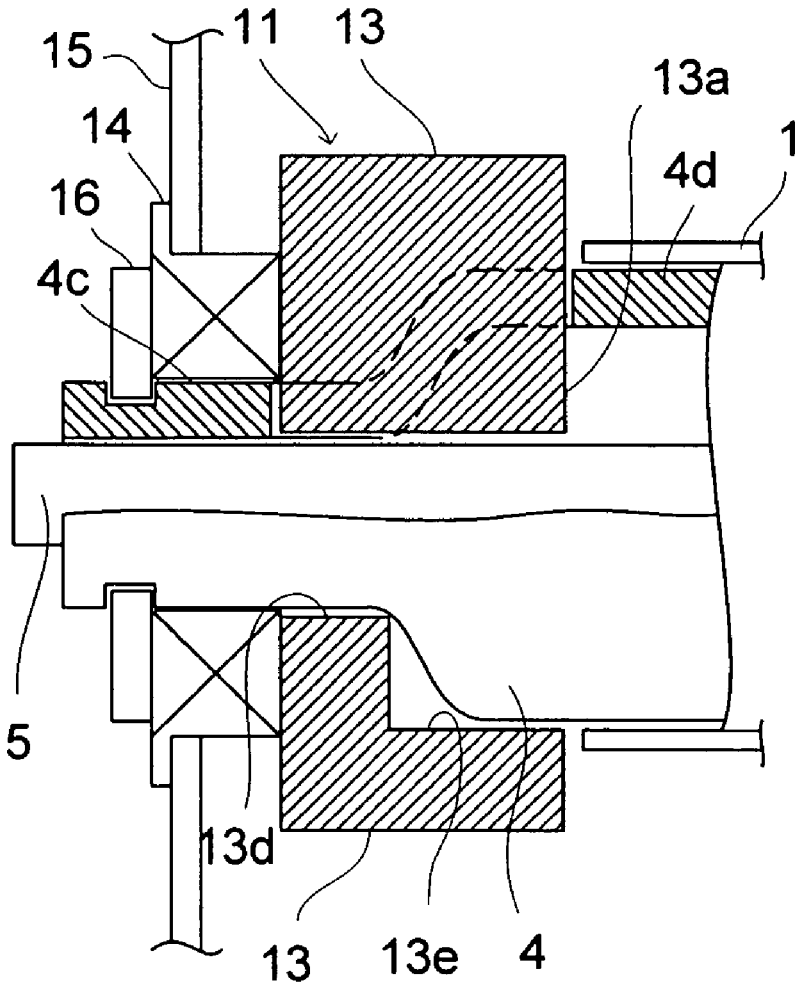
FIG. 14 is a sectional view, along the axial direction, of FIG. 13.

As shown in FIGS. 13 and 14, two rectangular holes 4*b* extending across the swaged part of the tension roller 4 to the central part 4*d* and penetrating the outer circumference of the tension roller 4 are formed at opposite positions. The meandering prevention member 11 is a ring-shaped member composed of two separately formed, identically shaped blocks 13. In a middle part on the inner circumferential face of each block 13 in the circumferential direction thereof, a rectangular-columnar boss 13*a* extending in the axial direction is formed. Moreover, in each end part of the outer circumferential face of each block 13, a fastening piece 13*b* is formed that has a hook-shaped claw 13*c* formed integrally therewith at the tip end thereof. On the inner circumference of each block 13, a diameter difference is formed perpendicularly so that it has a small-inner-diameter part 13*d* in one end side thereof in the axial direction and a large-inner-diameter part 13*e* in the other end side thereof in the axial direction. The outer diameter of the shaft part 4*c* of the tension roller 4 and the inner diameter of the small-inner-diameter part 13*d* of the block 13 are set approximately equal, and the outer diameter of the central part 4*d* of the tension roller 4 and the inner diameter of the large-inner-diameter part 13*e* of the block 13 are set approximately equal.

The meandering prevention member 11 is fitted to the tension roller 4 in the following manner. As shown in FIG. 13, from off the outer circumference of the tension roller 4 in directions perpendicular to the roller axis thereof, the two blocks 13 are fitted onto the outer circumference of the tension roller 4 so as to sandwich it. Meanwhile, the bosses 13*a* on the blocks 13 are fitted into the holes 4*b* in the tension roller 4. Moreover, the two blocks 13 are fastened together by tying together the adjacent fastening pieces 13*b* thereof with heat-resistant rubber belts (unillustrated) wound around them inward of the claws 13*c* thereof.

With this construction, as shown in FIG. 14, the side faces of the bosses 13*a* of the block 13 make contact with the edge of the fixing belt 1. This prevents the fixing belt 1 from being caught in the gap between the outer circumference of the tension roller 4 and the inner circumference of the meandering prevention member 11, and thereby prevents the meandering of the fixing belt 1 in the axial direction of the tension roller 4. It is also possible to use as the tension roller 4 an existing thin-walled one. This helps prevent an increase in the heat capacity of the tension roller 4.

In particular in this embodiment, as shown in FIG. 14, the meandering prevention member 11 covers the swaged part of the tension roller 4, and the other end face of the meandering prevention member 11 lies on the outer circumference of the central part 4*d* of the tension roller 4. Thus, no gap is left at the swaged part. This help prevent the fixing belt 1 from slipping into a gap. Moreover, in this embodiment, since gaps are formed between the circumferential direction end faces of the blocks 13, even when the tension roller 4 is heated by the heater lamp 5 and thus it thermally deforms and expands, the deformation is absorbed by the gaps, which thus contract. This helps prevent the meandering prevention member 11 itself from developing mechanical stress, and thus helps prevent breakage thereof. Moreover, as shown in FIG. 14, since the bosses 13*a* of the block 13 fit into the holes 4*b* in the outer circumferential face of the tension roller 4, the meandering prevention member 11, even when pressed by the meandering fixing belt 1, is prevented from deviating in the axial direction of the tension roller 4.

Figure 15:
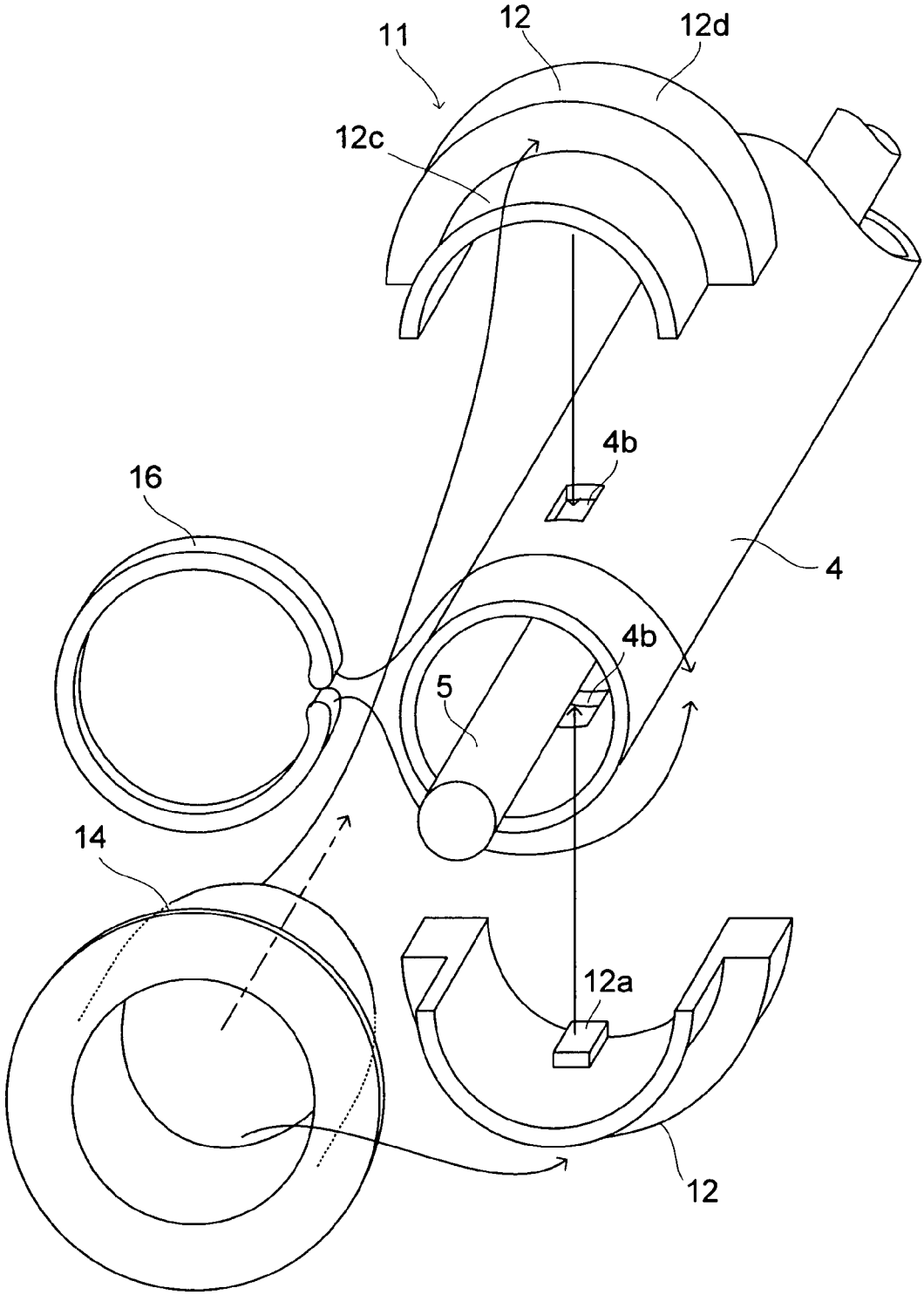
FIG. 15 is an exploded perspective view showing an end part of a tension roller in another example of the belt driving apparatus of the second embodiment of the present invention, with the fixing belt omitted.
Figure 16:
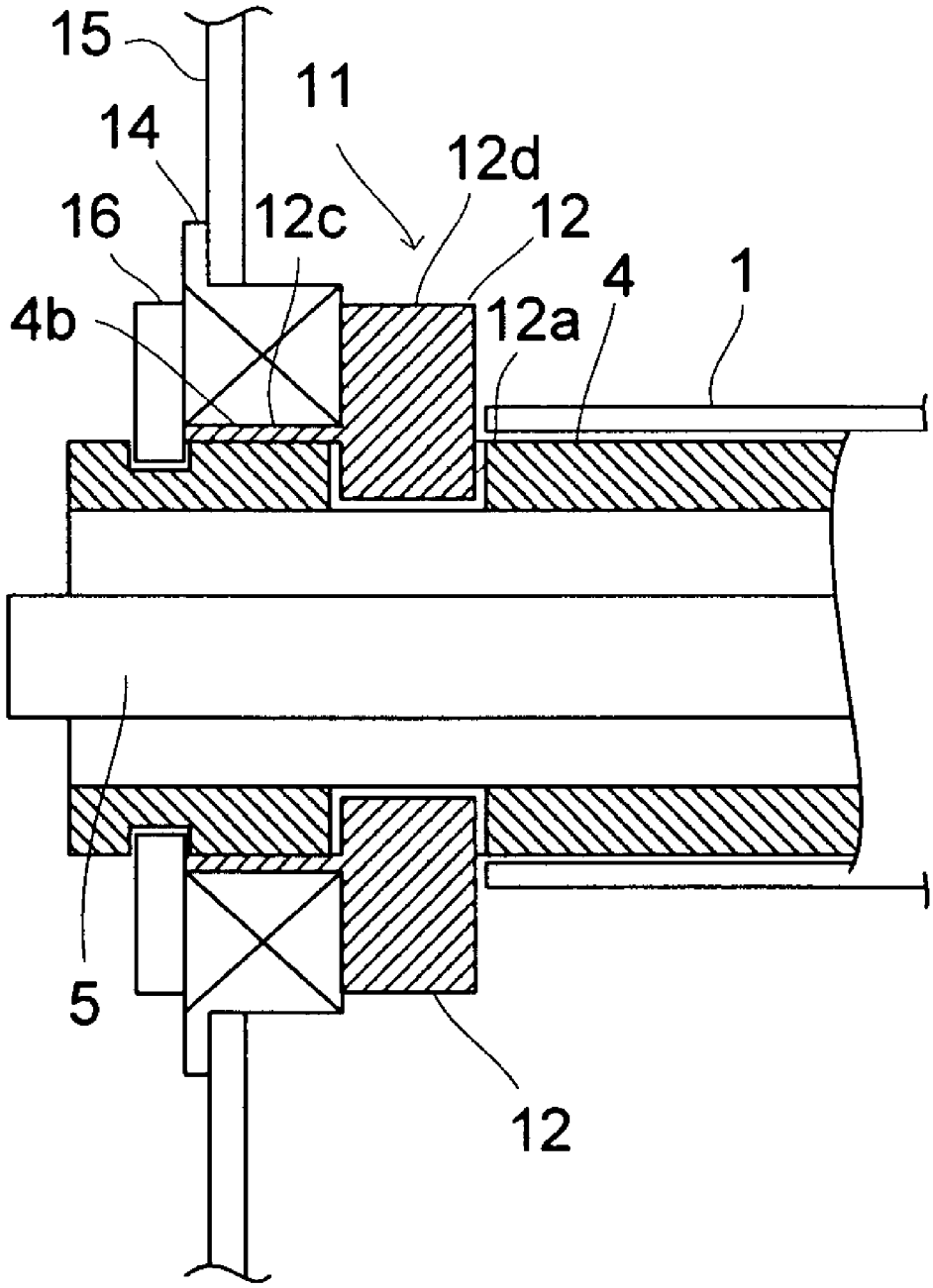
FIG. 16 is a sectional view, along the axial direction, of FIG. 15.
Figure 17A:
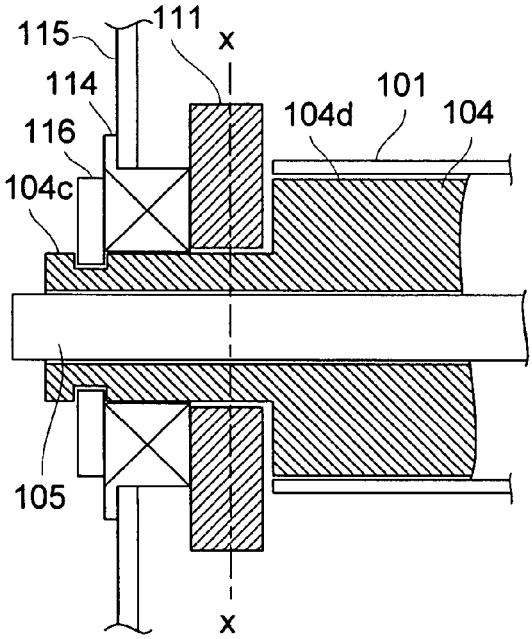
FIG.17A PRIOR ART
FIG. 17A is a sectional view, along the axial direction, showing an end part of a tension roller in a conventional belt driving apparatus.
Figure 17B:
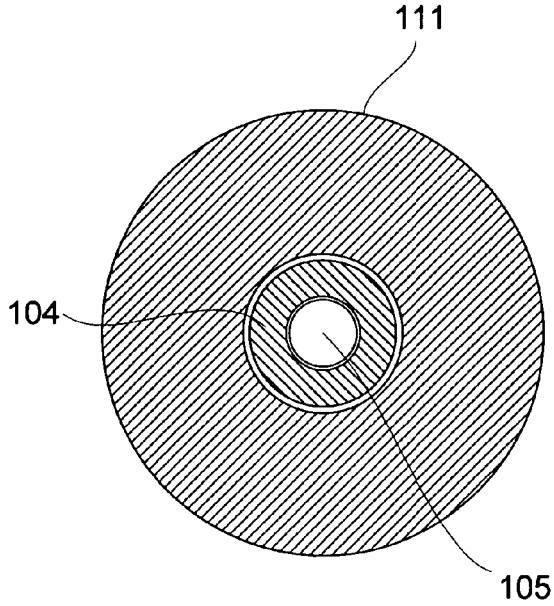
FIG.17B PRIOR ART
FIG. 17B is a sectional view along line x-x shown in FIG. 17A.

Belt driving apparatuses according to the present invention may be constructed in any manner other than specifically described as embodiments above; that is, many modifications and variations are possible within the scope and spirit of the present invention. For example, the boss-and-hole relationship between the tension roller and the meandering prevention member may be the other way around; specifically, bosses formed on the tension roller may be fitted into holes formed in the meandering prevention member. Such bosses and holes may be provided in three or more pairs, in which case it is preferable that the pairs be located at equal intervals. In the second and third embodiments described above, each meandering prevention member may be composed of three or more blocks. Adjacent blocks may be fastened together with any elastic members other than rubber belts, such as tension springs. Instead of being fastened together, the blocks may be held together by being pressed from around the outer circumference thereof with a structure, such as a bracket or bearing, that can rotatably supports the tension roller. For example, in the second embodiment described above, as shown in FIGS. 15 and 16, the meandering prevention member 11 may be composed of two blocks 12 each having two-level outer diameters around a smaller-outer-diameter part 12*c* and a large-outer-diameter part 12*d* thereof. In this case, when the meandering prevention member 11 is fitted to the tension roller 4, a bracket 14 is arranged around the smaller-outer-diameter parts 12*c*, which are arranged toward an end part of the tension roller 4, and a C-shaped stop ring 16 is fitted further outward in the axial direction to serve to prevent the meandering prevention member 11 from falling off. Here, it is preferable that the bracket 14 be one provided with a ball bearing. As shown in a sectional view in FIG. 16 but omitted from illustration in the perspective view in FIG. 15, a groove into which the stop ring 16 is fitted is formed all around the outer circumference of the tension roller 4, around which the stop ring 16 is fitted.

Although the embodiments described above all deal with cases where a belt driving apparatus is used as a belt fixing unit, a belt driving apparatus may be applied to a photoconductive belt apparatus or the like.

As described above, according to the present invention, the side faces of bosses on a meandering prevention member make contact with the edge of a belt and thereby prevent the belt from being caught in a gap between the outer circumference of a roller and the inner circumference of the meandering prevention member. Thus, it is possible to prevent the belt from meandering in the axial direction of the roller. Moreover, it is possible to use as a roller an existing thin-walled one. Thus, it is possible to prevent an increase in the heat capacity of the roller.

What is claimed is:

1. A belt driving apparatus for driving a belt comprising:

the belt hung around and between rollers; and a meandering prevention member provided in an end part of a roller to restrict meandering of the belt in a roller axial direction, wherein the meandering prevention member has a ring shape and is composed of a plurality of separately formed blocks which, when put together, make the ring shape, wherein the meandering prevention member rotates together with the roller by being engaged therewith, and wherein each of the blocks has fastening pieces formed in both end parts of an outer circumferential face thereof to protrude outward, and the blocks are fixed together in the ring shape as a result of adjoining fastening pieces being joined together by a tensile force acting to bring the fastening pieces closer together, all the blocks being held together in the ring shape in the end part of the roller and around the roller.

2. A belt driving apparatus for driving a belt, comprising:

the belt hung around and between rollers; and a meandering prevention member provided in an end part of a roller to restrict meandering of the belt in a roller axial direction, wherein the meandering prevention member is composed of a plurality of separately formed blocks, wherein the blocks are fixed together as a result of a bracket fitted around outer circumference faces of the blocks, all the blocks being held together in a ring shape around the end part of the roller, wherein, in the end part of the roller, a stop ring is fitted further outward than the meandering prevention member in the roller axial direction and further outward than the bracket in the roller axial direction, and wherein said bracket is interposed between said meandering prevention member and said stop ring.

3. A belt driving apparatus for driving a belt, comprising:

the belt hung around and between rollers; and a meandering prevention member provided in an end part of a roller to restrict meandering of the belt in a roller axial direction, wherein the meandering prevention member is composed of a plurality of separately formed blocks, wherein a hole is formed so as to penetrate an outer circumference of the roller, and a boss that fits into the hole is formed on an inner circumference of the meandering prevention member; and wherein a belt-side end face of the boss is flush with a belt-side end face of the meandering prevention member.

* * * * *